US010571864B2

(12) United States Patent
Hurni et al.

(10) Patent No.: US 10,571,864 B2
(45) Date of Patent: Feb. 25, 2020

(54) WATCH DIAL WITH THREE-DIMENSIONAL DECORATION, AND ASSEMBLY TOOLS

(71) Applicant: Montres Jaquet Droz SA, La Chaux-de-Fonds (CH)

(72) Inventors: David Hurni, La Chaux-de-Fonds (CH); Yann Leiggener, La Chaux-de-Fonds (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 58 days.

(21) Appl. No.: 15/830,098

(22) Filed: Dec. 4, 2017

(65) Prior Publication Data

US 2018/0173162 A1 Jun. 21, 2018

(30) Foreign Application Priority Data

Dec. 20, 2016 (EP) ..... 16205541

(51) Int. Cl.
*G04B 19/10* (2006.01)
*G04B 47/04* (2006.01)
(Continued)

(52) U.S. Cl.
CPC ..... *G04B 19/10* (2013.01); *G04B 19/065* (2013.01); *G04B 45/00* (2013.01); *G04B 45/0084* (2013.01); *G04B 47/04* (2013.01)

(58) Field of Classification Search
CPC .. G04B 19/065; G04B 19/12; G04B 45/0084; G04B 45/0092; G04B 19/14; G04D 3/0048; G04D 3/0092
See application file for complete search history.

(56) References Cited

U.S. PATENT DOCUMENTS 1,319,044 A * 10/1919 Cohan ..... G04B 19/14 368/236
1,400,421 A * 12/1921 Colomb ..... G04B 19/14 368/237
(Continued)

FOREIGN PATENT DOCUMENTS

CH 34979 6/1906
CH 700 140 A2 7/2010
(Continued)

OTHER PUBLICATIONS

Voutilainen, Kari, English Translation of EP 2952974, originally published on Dec. 9, 2015, retrieved from Espacenet on Mar. 29, 2019, full document (Year: 2015).*
(Continued)

*Primary Examiner* — Daniel P Wicklund
(74) *Attorney, Agent, or Firm* — Oblon, McClelland, Maier & Neustadt, L.L.P.

(57) ABSTRACT

A dial assembly for a timepiece includes a base plate on which feet are fixed. The dial assembly supports a three-dimensional decoration which includes at least one offset element at a remove from the base plate and fixed to the base plate through at least one foot. The at least one offset element includes at least one bush provided to be pressed in on an upper support abutting on a shoulder of this foot. The dial assembly includes a removable fitting which is used for pressing in all the bushes of the dial assembly. The dial assembly includes, opposite a lower support of each foot, a support pin of this lower support.

16 Claims, 3 Drawing Sheets

(51) Int. Cl.
*G04B 45/00* (2006.01)
*G04B 19/06* (2006.01)

(56) References Cited

U.S. PATENT DOCUMENTS 1,903,003 A * 3/1933 Mansfield ..... G04B 19/14
368/236
2,196,998 A * 4/1940 Lodge ..... G04B 19/10
29/896.32
4,916,798 A * 4/1990 Ballast ..... B21D 39/032
264/249
8,354,032 B2 * 1/2013 Dinger ..... B81C 3/008
216/2
8,976,630 B2 * 3/2015 Oshio ..... G04B 19/065
368/205
2009/0080294 A1 3/2009 Arita et al.
2011/0236580 A1 * 9/2011 Winkler ..... B21J 1/006
427/282

FOREIGN PATENT DOCUMENTS

CH 706 636 A2 12/2013
CH 706 636 B1 12/2013
CH 710 769 A2 8/2016
EP 2952974 A1 * 12/2015 ..... G04B 19/14
FR 1414795 A * 10/1965 ..... G04D 3/0048
GB 2052113 A * 1/1981 ..... G04B 19/14

OTHER PUBLICATIONS

European Search Report dated Jun. 23, 2017 in European Application 16205541.2, filed on Dec. 20, 2016 (with English Translation of Categories of Cited Documents).

* cited by examiner

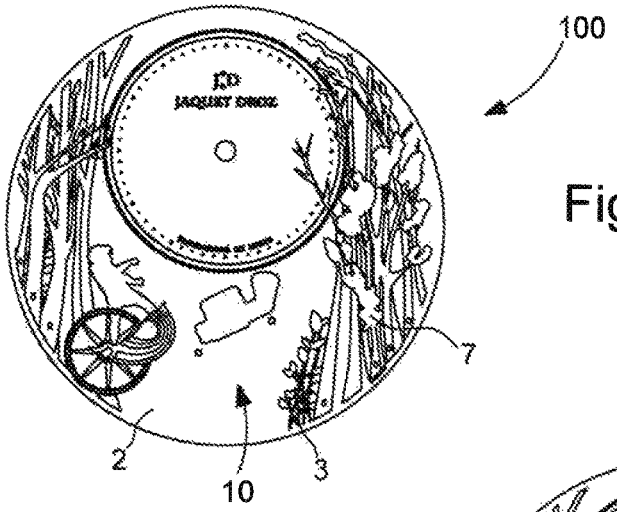
Fig. 1
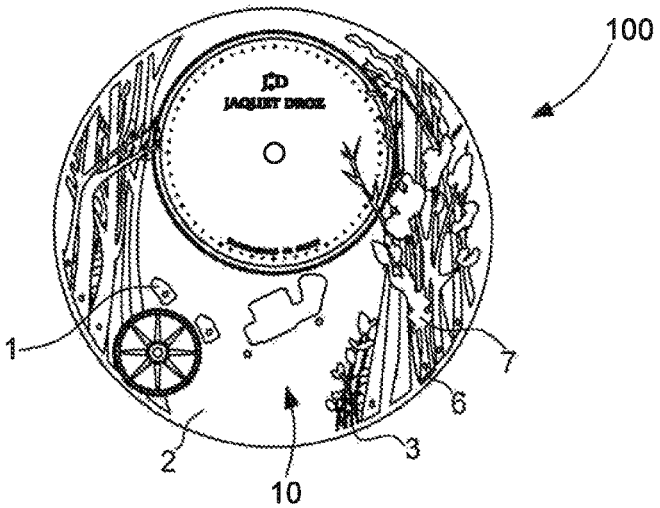
Fig. 2
Fig. 3
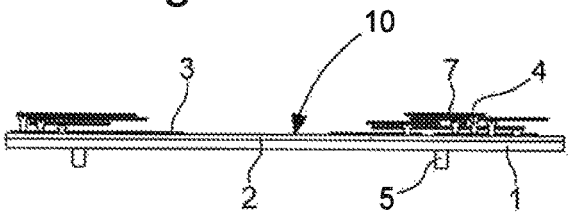
Fig. 6
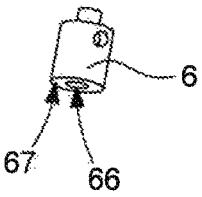
Fig. 5
Fig. 4
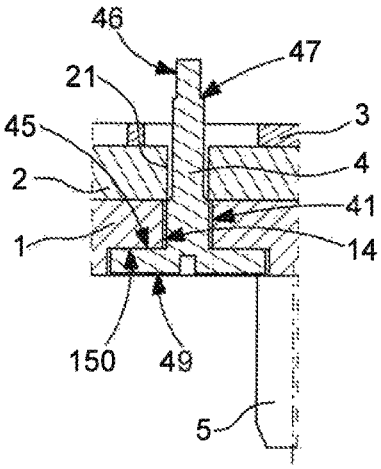
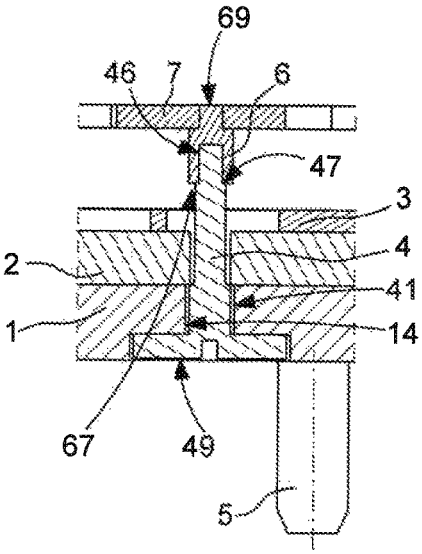

WATCH DIAL WITH THREE-DIMENSIONAL DECORATION, AND ASSEMBLY TOOLS

This application claims priority from European patent application No. 16205541.2 filed on Dec. 20, 2016, the entire disclosure of which is hereby incorporated herein by reference.

FIELD OF THE INVENTION

The invention relates to a dial assembly for a timepiece, comprising a base plate on which feet are fixed, directly or indirectly, said dial assembly supporting a three-dimensional decoration which comprises at least one offset element at a remove from said base plate and fixed to said base plate through at least one said foot.

The invention also relates to a timepiece, in particular a watch, comprising at least one such dial assembly.

The invention relates to the field of components of the external timepiece parts.

BACKGROUND OF THE INVENTION

In the field of luxury watchmaking, the external parts of a watch or of a timepiece assume utmost importance.

In order to highlight the standard display components, some timepieces comprise, between the base plate of the dial and the glass, a decoration which gives a particular personality to the timepiece, comprising, according to the case, an automaton, a decoration in relief, or the combination of both, the decoration in relief which, in some automaton timepieces, can be involved in the operation of the automaton by hiding some positions of an animated moving body. This decoration can also comprise components which are moveable under the effect of gravity, suspended, or even circulate in a track ad hoc. Some decorations are produced with materials which are both precious and fragile, such as glass, feather, mother-of-pearl, wood or even of very great delicacy in order to allow transparency effects, and the fixing of such decorative elements is particularly intricate, especially when these decorations open out in three dimensions, some above the others.

Document CH 710 769 A2 BREGUET describes a structure comprising a housing receiving a removable element which cooperates, in an operating position, abutting directly or indirectly on a receiving surface of the housing, by an attraction or repulsion force under the effect of a magnetic and/or electrostatic field generated by the structure or the element, in which, apart from this operating position, the element is moveable in the housing along a direction parallel to that of the field, with a deflection limited by a mechanical limit stop between an abutting surface of the structure and a complementary abutting surface of the element, which opposes direct extraction of this element.

The document CH 700 140 A2 COREDEM describes a shock-resistant bearing for a balance spring. This bearing is formed of only a single element which has an olive-cut offset hole, such that the shape of the hole places the contact point between the bearing and the cylindrical part of the pivot of the balance-spring axis at a minimum distance from the planar and perpendicular range of the balance-spring axis.

The document CH 34 979 A CHATELAIN describes a support mechanism for automatons, applied to a watch, comprising a finger pivoted on a fixed element of the movement and intended to support an automaton, one end of this finger being engaged, with a slight play, between the two teeth of a fork ending an arm of the escapement fork, an arm which is integral with the fork.

SUMMARY OF THE INVENTION

The present invention is directed at ensuring secure fixing of the most fragile decorative elements, and allowing their assembly by normally qualified clockmaking operatives.

To this end, the invention relates to a dial assembly for a timepiece.

The invention also relates to a timepiece, in particular a watch, comprising at least one such dial assembly.

BRIEF DESCRIPTION OF THE DRAWINGS

Other features and advantages of the invention will appear upon reading the detailed description which will follow, with reference to the annexed drawings in which:

FIG. 1 represents, schematically and in front view, a watch comprising a dial assembly according to the invention, comprising a complex three-dimensional decoration with numerous elements of a very small section, distributed along superimposed planes, and serving as base decoration for an automaton in the central part, display of the hour taking place on a small dial which, like the decorative elements, is offset relative to the base plate, and is also made of a material of great value;

FIG. 2 is an enlarged detail of the dial assembly of FIG. 1, after dismantling of an automaton character and the hands, and shows, above a base plate, a first level of decorative foliage mounted as an appliqué, and several offset decorative levels in the form of trees or other vegetation;

FIG. 3 represents, schematically and in side view, the dial assembly of FIG. 2, comprising, under the base plate, dial feet, and above the base plate, a plurality of feet of various lengths supporting the decorative elements;

FIG. 4 represents, schematically and in sectional view passing through its axis, one of these feet screwed on via the underside of the base plate;

FIG. 5 represents, similarly to FIG. 4, the same foot, covered by a bush which an offset decoration comprises;

FIG. 6 represents, schematically and in perspective, this bush;

FIG. 11 represents, similarly to FIG. 5, a variant of the invention with fixing of an offset flexible decoration, fixed to two bushes which are introduced on their respective feet by a removable structure which is provided in order to be detached from the bushes after they are pressed in;

DETAILED DESCRIPTION OF PREFERRED EMBODIMENTS

Figure 8:
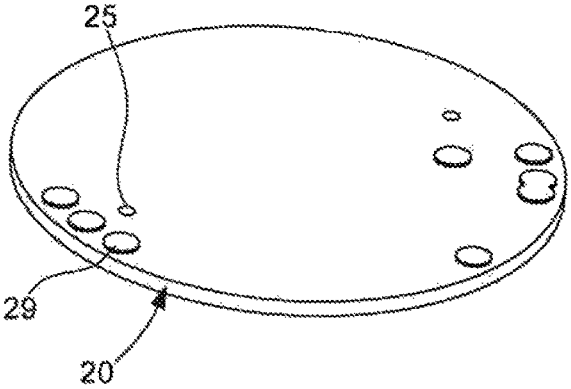

The invention relates to a dial assembly 10 for a timepiece 100.

This dial assembly comprises two sub-assemblies:

- a removable fitting 20 which is used only during the decoration fixing phase and which is not integrated in the timepiece;
- and a traditional dial, intended to be integrated in the timepiece; which comprises a base plate 1 supporting all the decorative or/and display elements, and on which feet 4 are fixed, directly or indirectly, for example via, at the level of the plates, links connected to the base plate 1.

The invention is directed more particularly at producing the assembly of decorative elements without having recourse to gluing, by favouring mechanical retaining means, even for very fine or very fragile decorations.

This dial assembly 10 comprises a three-dimensional decoration, which comprises at least one offset element 7, which is at a remove from the base plate 1 and fixed to this base plate 1 through at least one foot 4.

According to the invention, at least one said offset element 7 comprises at least one bush 6 or pipe provided to be pressed in, by abutting on an upper support 69 which it comprises, on an upper support 46 which a foot 4 comprises, and abutting on a shoulder 47 which this foot 4 comprises. Preferably, this bush 6 comprises a blind- or through-boring 66, provided to cooperate with the upper support 46, and a straight support face 67 provided to cooperate with the shoulder 47. What is essential is that the upper support 69 thereof is easily disengaged for support of a tool for pressing in thereof. This bush 6 can assume various forms: the boring 66 can be blind as in FIG. 5, or a through-boring as in FIGS. 7, 11 and 12. The through-boring version can allow pressing in, after mounting on the foot 4, of an additional decorative element, such as a semi-precious stone, or other.

In a particular variant, at least one offset element 7 comprises a single bush 6. More particularly, at least one such offset element 7 comprising a single bush 6 is cantilevered relative to this single bush 6, in fact, the bush 6 provides sufficient rigidity to allow such retention of an offset element 7 suspended in the manner of a hand.

In another variant, and as illustrated by the Figures, at least one said offset element 7 comprises a plurality of such bushes 6. More particularly, each offset element 7 comprises several bushes 6.

In another variant, and as illustrated by the Figures, at least one foot 4, comprising an upper support 46 and a shoulder 47 for receiving a bush 6, also comprises an external thread 41 provided to cooperate with an internal thread 14 which the base plate 1 comprises, and a support face 45 provided to cooperate as limit stop with a complementary limit stop surface 150 which the base plate 1 comprises, opposite a lower support 49 which this foot 4 comprises.

Figure 11:
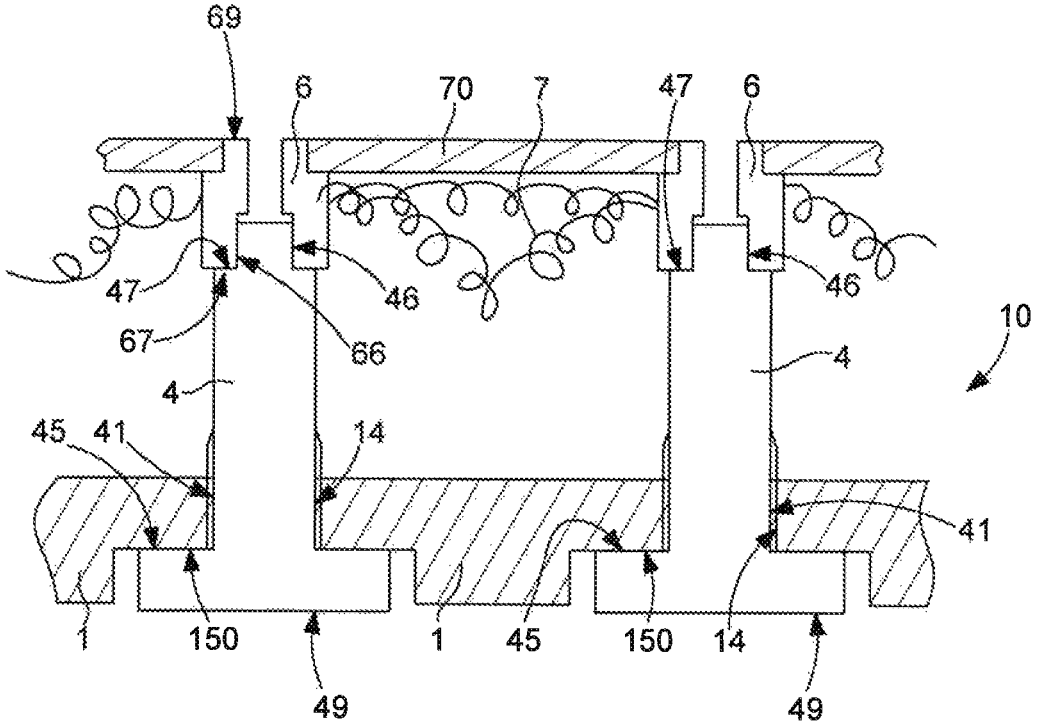

In another variant, and as illustrated by FIG. 11, when the offset decoration 7 is too fragile or too flexible, such as a feather, a wire, a garland, a suspended moving body, or a decorative element suspended by a wire, or even a thin crystal or sapphire decoration, or other, the dial assembly 10 comprises a removable structure 70 which is adapted to such an offset element 7, comprising at least one bush 6, for example riveted to, or even pressed in on such a bush 6. This removable structure 70 is more rigid than the offset element 7 and is provided to allow positioning of each bush 6 which the offset element 7 comprises, and retention thereof during an operation for pressing in each bush 6 on its respective foot 4. This removable structure 70 comprises retaining means on each bush 6, by friction or/and adhesion or/and magnetic or electrostatic field, of an axial resistance less than the pressing in force, in order to allow easy extraction of this removable structure 70 after pressing in each bush 6, and for its extraction from the assembled dial assembly 10 during its insertion into a timepiece. In fact, fixing by bushes according to the invention lends itself well to the case where the decoration is such a flexible or fragile object, if the two bushes can be hidden. It suffices to make the two bushes integral with the removable assembly structure 70, for example a piece of cardboard or a plastic film comprising the exact centre distance of the bushes, delicately, for example with a very weak adhesive, sufficing exactly to make possible, in the example of FIG. 11, handling of the 70+7+6+6 assembly, to position the bushes 6 in place on their axes 4, to press in them. As the adhesive fixing is intended to be less that the force of pressing in, it suffices to pull on the removable structure 70 in order to remove it, the decoration 7 being fixed directly to the bushes 6.

For example, the removable structure 70 can be formed of a rigid film made of plastic material, in particular transparent, in order to facilitate positioning of the bushes, of a mesh, of a sheet of cardboard or thick paper, or similar.

According to an advantageous feature of the invention, the dial assembly 10 comprises a removable fitting 20 provided in order to be used for pressing in all the bushes 6 which this dial assembly 10 comprises. This fitting serves only for this operation and is extracted from the assembled dial assembly 10 during insertion of the dial in a timepiece. This removable fitting 20 comprises, opposite a lower support 49 which each foot 4 comprises, a support pin 29 for cooperating as a limit stop with this lower support 49.

Preferably, the dial assembly 10 comprises, at the level of its base plate 1, at least one dial foot 5, and the removable fitting 20 comprises a positioning boring 25 for receiving, with minimum clearance, each such dial foot 5.

Figure 7:
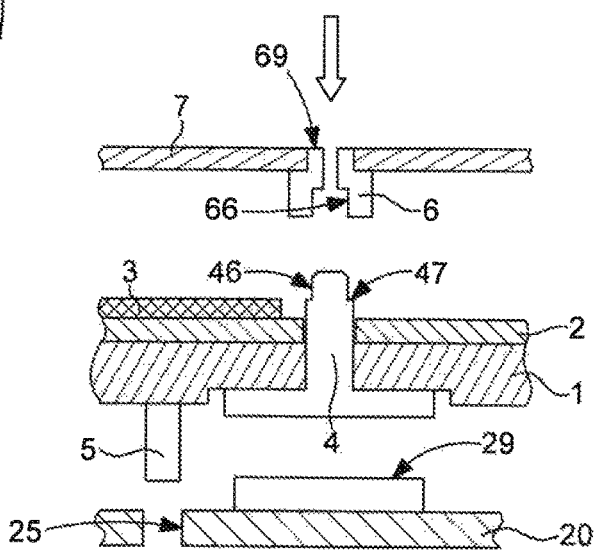
FIG. 7 represents, schematically and in partial section, in the lower part, the cooperation of the base plate, equipped with its feet and positioning pins, and a removable fitting, illustrated in FIG. 8, and which the dial assembly comprises and which is used solely for the operation of pressing in the bushes on the feet, with alignment of a boring of this fitting with a positioning pin, and of a foot with a support contact of this fitting, whilst, in the upper part, a decorative element provided with its bush is predisposed aligned with the same foot, ready to be pressed in by a user or by a piston, not represented, which this fitting comprises.
Figure 10:
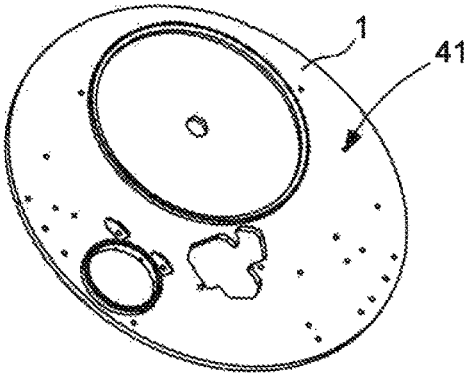
FIGS. 9 and 10 represent, schematically, in front view and exploded, the lower levels of the dial assembly before assembly of its vegetation decoration, with the housings of the various feet.
Figure 9:
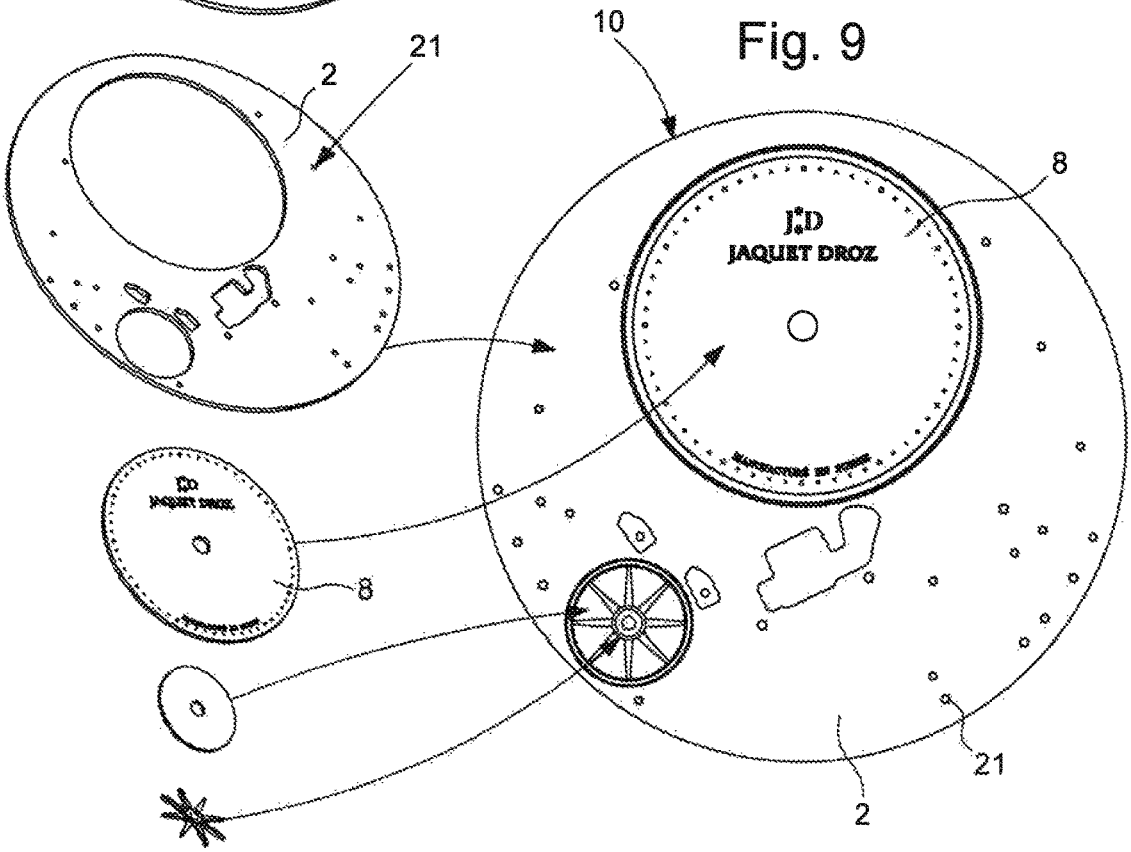

FIG. 7 illustrates the cooperation of the base plate 1, equipped with its feet 4 and dial feet 5, and the removable fitting 20, with alignment of a boring 25 of this fitting 20 with a dial foot 5, and of a foot 4 with a support pin 29 of this fitting 20, whilst, in the upper part, an offset decorative element 7 provided with its bush 6 is predisposed aligned with the same foot 4, ready to be pressed in.

Figure 12:
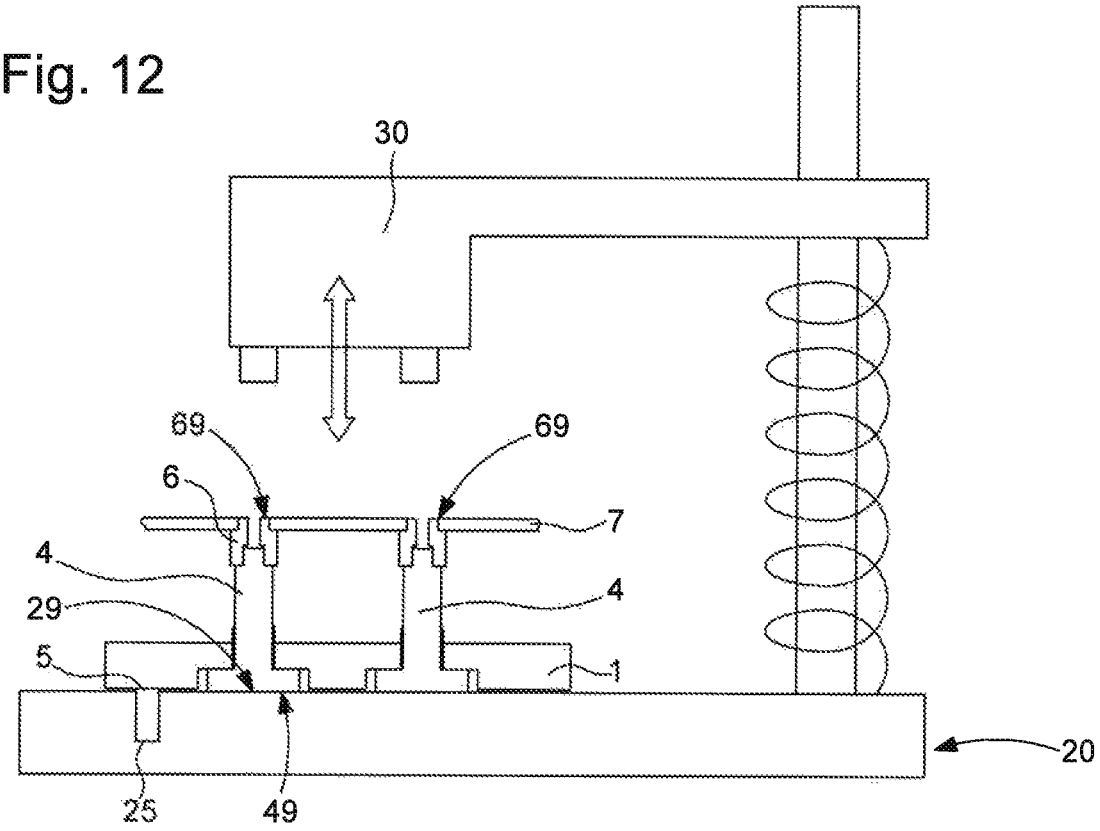
FIG. 12 represents, schematically and in side view, the removable fitting in a variant where it is provided with a piston in the upper part, the base plate positioned on the fitting, an offset decoration positioned with its pressed in bushes on the respective feet thereof.

FIG. 12 illustrates a variant of the removable fitting 20 which comprises guide means for at least one upper piston 30 which is moveable along the axial direction of the feet 4, and provided to exert a simultaneous thrusting force on all the upper supports 69 of the bushes 6 of the same offset element 7, for pressing in thereof on their respective feet 4. More particularly, this upper piston 30 is provided to exert a simultaneous thrusting force on all the upper supports 69 of all the bushes 6 of all the offset elements 7 which the dial assembly 10 comprises, for pressing in thereof on their respective feet 4.

The invention relates also to a timepiece 100 comprising at least one such dial assembly 10. More particularly, this timepiece 100 is a watch.

What is claimed is:

1. A dial assembly for a timepiece, comprising:

a base plate on which at least one foot is fixed, directly or indirectly, the at least one foot having a longitudinal axis, and a three-dimensional decoration which comprises at least one offset element at a remove from said base plate and fixed to said base plate through at least one said foot, wherein at least one said offset element comprises at least one bush provided to be pressed in along the longitudinal axis of the at least one foot on an upper support of the at least one said foot such that the upper support is positioned within a bore of the at least one bush, and a support face on an end of said at least one said foot directly abuts a shoulder of said foot wherein at least one said foot, comprising one said upper support and one said shoulder for receiving one said bush, also comprises an external thread provided to cooperate with an internal thread of said base plate, and a support face provided to cooperate as limit stop with a complementary limit stop surface of said base plate, opposite a lower support of said foot.

2. The dial assembly according to claim 1, wherein at least one said offset element comprises a single bush.

3. The dial assembly according to claim 2, wherein at least one said offset element is cantilevered relative to said single bush.

4. The dial assembly according to claim 1, wherein at least one said offset element comprises a plurality of said bushes.

5. The dial assembly according to claim 1, wherein said dial assembly comprises a removable structure which is adapted to one said offset element, comprising at least one said bush, said removable structure being more rigid than said offset element and provided to allow positioning of each said bush of said offset element, and retention thereof during an operation for pressing in each said bush on one said respective foot, and said removable structure comprising retaining means on each said bush, by friction or/and adhesion or/and magnetic or electrostatic field, of axial resistance less than the pressing force, in order to allow extraction of said assembled removable structure after pressing in each said bush, and for its extraction from said dial assembly during its insertion into a timepiece.

6. The dial assembly according to claim 1, wherein said dial assembly comprises a removable fitting provided for pressing in the said bushes which said dial assembly comprises, said removable fitting comprising, opposite a lower support of each said foot, a support pin of said lower support.

7. The dial assembly according to claim 6, wherein said dial assembly comprises at least one dial foot, and wherein said removable fitting comprises a positioning boring for receiving, with minimum clearance, each of said at least one dial foot.

8. The dial assembly according to claim 6, wherein said removable fitting comprises guide means for at least one upper piston which is moveable along the axial direction of said at least one foot, and provided to exert a simultaneous thrusting force on said upper support of each of said at least one bush of at least one said offset element, for pressing in thereof on the respective said at least one foot.

9. The dial assembly according to claim 8, wherein said upper piston is provided to exert a simultaneous thrusting force on said upper support of each of said at least one bush of each of said at least one offset element of said dial assembly, for pressing in thereof on the respective said at least one foot.

10. A timepiece comprising at least one dial assembly according to claim 1.

11. The timepiece according to claim 1, wherein said timepiece is a watch.

12. The dial assembly according to claim 1, wherein the at least one foot extends through the base plate.

13. A dial assembly for a timepiece, comprising:

a base plate on which at least one foot is fixed, directly or indirectly, and a three-dimensional decoration which comprises at least one offset element at a remove from said base plate and fixed to said base plate through at least one said foot, wherein at least one said offset element comprises at least one bush provided to be pressed in on an upper support of the at least one said foot, and abutting on a shoulder of said foot, and wherein said dial assembly comprises a removable fitting provided for pressing in the said bushes which said dial assembly comprises, said removable fitting comprising, opposite a lower support of each said foot, a support pin of said lower support.

14. The dial assembly according to claim 13, wherein said dial assembly comprises at least one dial foot, and wherein said removable fitting comprises a positioning boring for receiving, with minimum clearance, each of said at least one dial foot.

15. The dial assembly according to claim 13, wherein said removable fitting comprises guide means for at least one upper piston which is moveable along the axial direction of said at least one foot, and provided to exert a simultaneous thrusting force on said upper support of each of said at least one bush of at least one said offset element, for pressing in thereof on the respective said at least one foot.

16. The dial assembly according to claim 15, wherein said upper piston is provided to exert a simultaneous thrusting force on said upper support of each of said at least one bush of each of said at least one offset element of said dial assembly, for pressing in thereof on the respective said at least one foot.

* * * * *